United States Patent [19]

Hodge

[11] 4,366,803

[45] Jan. 4, 1983

[54] COUNTERROTATING CIRCULATING HYDRAULIC FURNACE

[76] Inventor: Warren L. Hodge, 525 NE. 6th St., Staples, Minn. 56479

[21] Appl. No.: 208,157

[22] Filed: Nov. 19, 1980

[51] Int. Cl.[3] ..... F24C 9/00

[52] U.S. Cl. ..... 126/247

[58] Field of Search ..... 126/247; 122/26; 416/128, 125, 124, 129, 122, 181, 184; 237/12.1, 71; 165/86; 188/296

[56] References Cited

U.S. PATENT DOCUMENTS

| | | | |
|---|---|---|---|
| 1,682,102 | 8/1928 | Allen | 122/26 |
| 1,718,175 | 6/1929 | Nilson | 122/26 |
| 3,147,957 | 9/1964 | Martin | 416/129 X |
| 3,933,007 | 1/1976 | Eskeli | 126/247 X |

FOREIGN PATENT DOCUMENTS

| | | | |
|---|---|---|---|
| 371529 | 10/1920 | Fed. Rep. of Germany | 122/26 |

*Primary Examiner*—Samuel Scott
*Assistant Examiner*—Randall L. Green
*Attorney, Agent, or Firm*—Kinney, Lange, Braddock, Westman and Fairbairn

[57] ABSTRACT

A hydraulic furnace or heat source comprising a rotor including a plurality of counterrotating discs which circulate a hydraulic fluid under pressure, and in so doing the rotor converts the input energy into heat energy in the hydraulic fluid, which can then be used as a radiant heat source or used in a heat exchanger to provide for forced air heating of buildings or other structures.

16 Claims, 14 Drawing Figures

Fig. 4
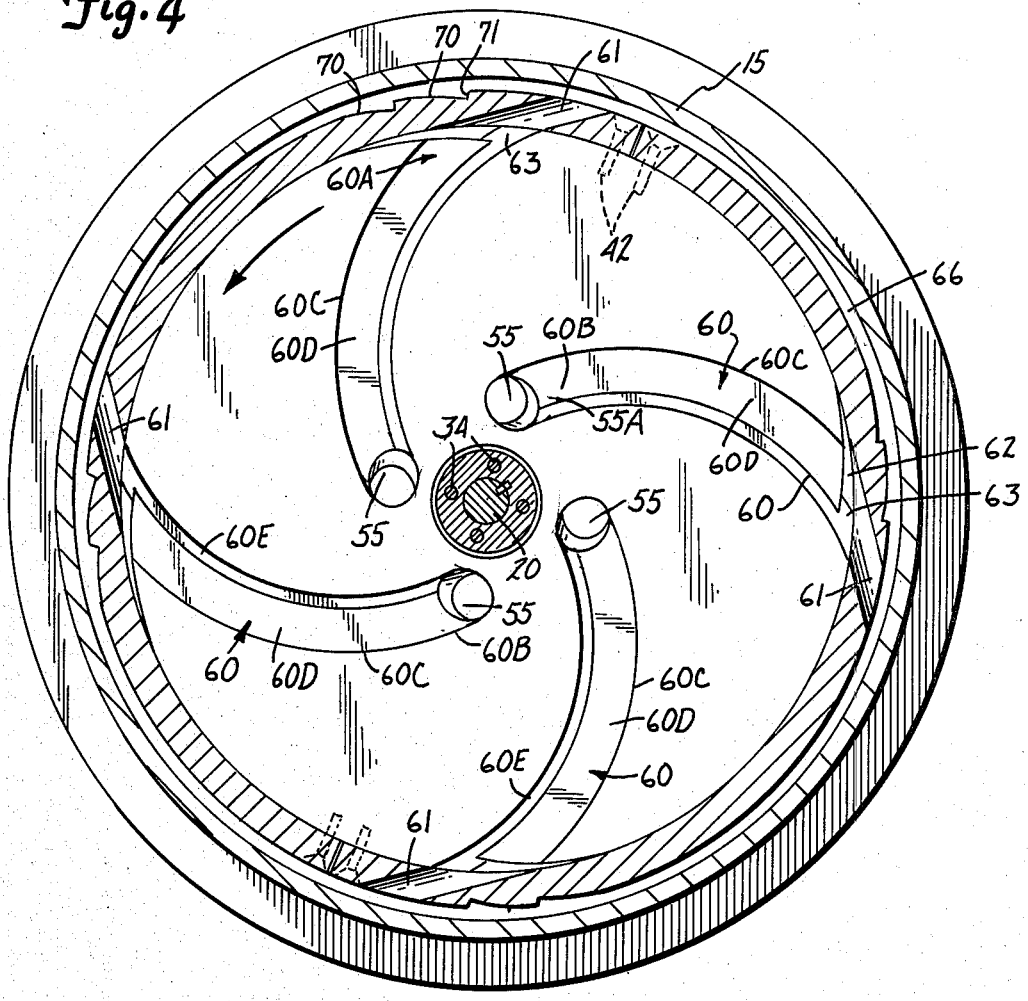
Fig. 6
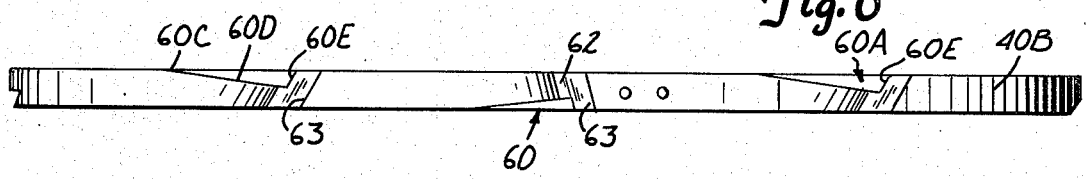
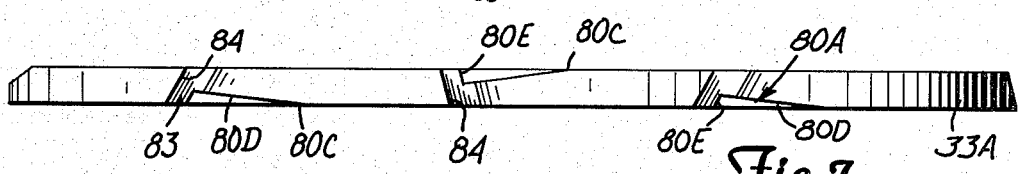
Fig. 7

COUNTERROTATING CIRCULATING HYDRAULIC FURNACE

BACKGROUND OF THE INVENTION

1. Field of the Invention

The present invention relates to a furnace utilizing a circulating, pressurized hydraulic fluid for providing heat energy.

2. Prior Art

In the prior art there have been various types of furnaces which convert forms of energy into heat. Some of these have involved the use of conventional hydraulic pumps, but these are generally inefficient and do not provide the necessary control for rapid heating of rooms, or for sustained operation.

SUMMARY OF THE INVENTION

The present invention relates to a circulating hydraulic furnace utilizing a rotor made up of discs that will create shear and pressure in hydraulic fluid to convert input rotary energy from an electric motor or other power source into heat energy. The hydraulic fluid to which the heat is added can be circulated in a closed system, and used either as a radiant heat source, or through suitable heat exchange means as a forced air heat source for heating structures.

The device provides heat very quickly and also provides very high temperatures in the heat source for great efficiency to consequently reduce heating costs.

In particular, the device comprises a centrifugal disc type flow inducer which shears and pressurizes the hydraulic fluid so that the fluid will be circulated from a reservoir through a heat exchanger back to the source if desired. The entire unit can be submerged in a hydraulic fluid reservoir so that the entire reservoir acts as a radiant source.

The centrifugal rotor comprises a plurality of interdigitated discs, with every other disc rotating in an opposite direction in the preferred form, and the discs are preferably provided with grooves on their side faces. The grooves face the oppositely rotating discs and are arranged to tend to urge the oil centrifugally outwardly.

In the preferred embodiment, the discs are counterrotating, so that one set of discs will rotate clockwise and the other set will rotate counterclockwise and viewed from an input end of the mounting shaft. However, if one set of discs is held stationary, and the other rotated, the same action will occur except that the heating effect will not be as rapid.

In one specific form, an outer housing is provided that houses the discs for rotation, and one set of discs is connected to a stabilizer, or shell that surrounds both of the sets of discs. The discs force the oil out of the stabilizer into the cavity of the outer housing, and then to the outlet for circulation.

The inlet for fluid circulation is through port means defined adjacent the axis of rotation of the individual discs.

Temperatures as high as 600° F. can be reached without difficulty, particularly if auxiliary pressurization of the housing is provided with an accumulator. If the unit is directly used to provide hydraulic fluid to a radiant heat source, the fluid will be maintained in a temperature range preferably between 150° F. and 250° F. If the fluid is used in a forced air heat exchanger, so that air is passed over the heat exchanger, and then the air is used for heating rooms, the hydraulic fluid temperature is normally kept in the range of between 130° F. and 200° F.

The temperature of the hydraulic oil that is provided from the furnace can be sensed with a suitable thermostatic element to shut off the power source to the furnace and turn it back on when the temperature range that is selected have been exceeded. Likewise, of course, conventional room thermostat controls can be used as an override for initiating the furnace operation.

The furnace is compact, thus saving a great deal of space, but yet providing heat in an extremely efficient manner for conversion of the input energy into heat for heating the rooms. The utilization of the unique spinning discs provides for substantially instantaneous heat upon start of operation. With counterrotating discs the ratio of rotation between the discs can be altered by suitable gearing, or drive belts, in order to provide exceedingly good control over the temperature of the fluid, thereby increasing the efficiency.

BRIEF DESCRIPTION OF THE DRAWINGS

FIG. 4 is a sectional view taken as on line 4—4 in FIG. 3;

FIG. 6 is an edge view of a counterclockwise rotating disc shown in FIG. 4;

FIG. 7 is an edge view of a clockwise rotating disc shown in FIG. 5;

DESCRIPTION OF THE PREFERRED EMBODIMENTS

Figure 1:
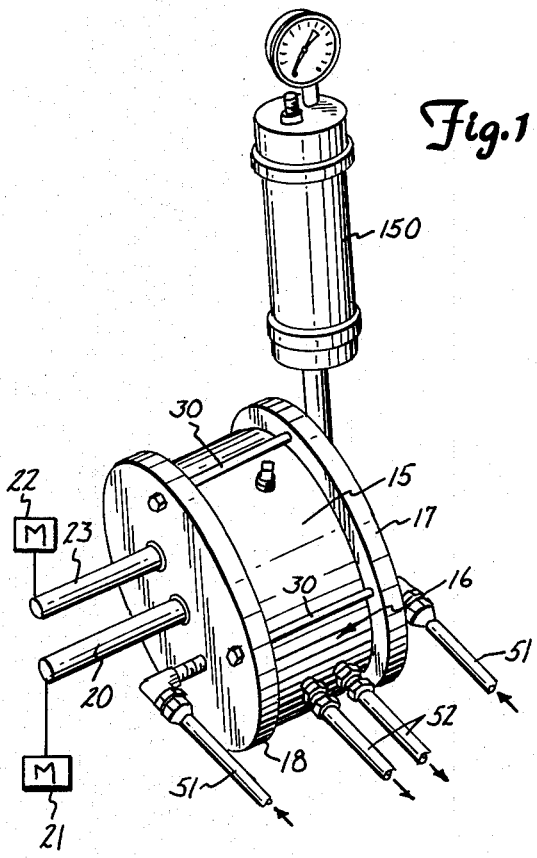
FIG. 1 is a perspective view of a furnace made according to the present invention.

In FIG. 1 a hydraulic furnace made according to the present invention is indicated generally at 16, and includes an outer housing 15, a first end cap 17, and a second end cap 18. The end caps 17 and 18 are used for rotatably mounting a first through shaft 20 in the form shown, which shaft is mounted in suitable bearings and is adapted to be driven by a motor or other power source indicated generally at 21.

Figure 2:
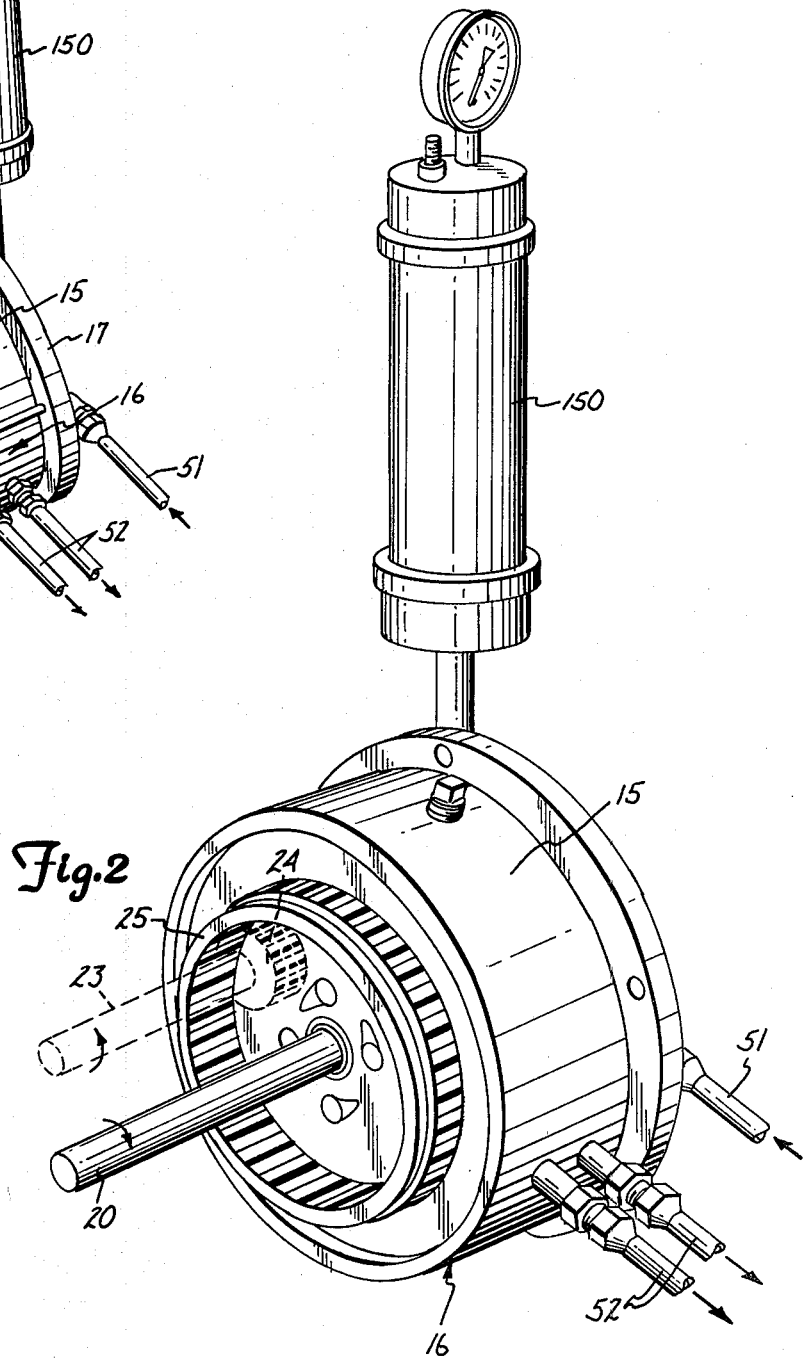
FIG. 2 is an enlarged perspective view of the furnace of FIG. 1 with one end cap removed to show drive members for such furnaces.

The end cap assembly 18 also mounts a second or auxiliary shaft 23 which as can be seen in FIG. 2 where the end cap 18 is removed, drives a spur gear 24 that in turn drives an internal ring gear 25 which as will be explained is attached to drive one portion of an inner rotor assembly 26.

The end caps 17 and 18 are held in place with suitable cross bolts 30 in a usual manner to close the outer housing 15 at its ends and form an interior chamber.

The shaft 20 is mounted on the central axis of the cylindrical or annular housing 15, and forms the center of rotation for the pressure creating rotor assembly 26. The rotor comprises two individual sets of generally flat, counterrotating discs. A first set of discs is indicated at 33 and includes discs 33A, 33B, 33C and 33D. These discs are mounted as a common assembly driven by shaft 20. The disc set is held together with a desired number of longitudinally (axially) extending cap screws 34 which pass through discs 33A, 33B, 33C and which are threaded into disc 33D. Additionally, there are spacers indicated at 35 between the discs. One spacer 35 is between discs 33A and 33B; one spacer 35 is between the discs 33B and 33C; and one spacer 35 is between discs 33C and 33D. The spacers are short collars that do not extend radially out beyond the center shaft 20 a great deal, because the second set 40 of discs forming part of the central heat generating rotor unit are rotatably mounted to rotate relative to the shaft 20 and thus relative to the spacers 35. The discs of the second set have holes which surround the spacers.

The second set of discs 40, includes a first end disc 40A, intermediate discs 40B, 40C and 40D, which are interdigitated (alternated) between the discs 33A, 33B, 33C and 33D, and a second end disc 40E. The discs 40A through 40E are held together as a unit through the use of an outer annular stabilizer shell or ring 41, which is made up of two portions attached to the outer edges of the discs 40A through 40E with suitable screws shown at 42. These screws 42 are threaded in a radial direction into the peripheral edges of these discs at appropriate locations.

The end discs 40A and 40E, respectively, of the second set of discs are rotatably mounted on suitable bearings indicated at 45 on the shaft 20A, and between the end plates 17 and 18. The shaft 20 in turn is rotatably mounted on suitable bearings 46 in the end plate 17, and in a bearing 47 in the end plate 18.

Thus, it can be seen that the disc set 40 can rotate relative to the disc set 33. Each disc set rotates as a unit. The discs are interdigitated, or in other words alternated, along the axial length of the shaft 20 between the end caps 17 and 18 of the housing 15.

It should also therefore be noted that the stabilizer 41 is spaced closely from the inner surface of the housing 15 so that, as will be explained, substantial pressure is generated in forcing the hydraulic fluid in its path of movement through the furnace.

The shaft 20 and the shaft 23 can be independently powered. The shaft 23 as shown is mounted in a suitable bearing 50 in the end cap 18. One or more bearings can be provided for shaft 23. The spur gear 24 drives the ring gear 25. The ring gear 25 is fixed to the end disc 40A, and thus, through the stabilizer or shell 41, all of the discs 40A through 40E are driven simultaneously as a unit by the motor 22 driving shaft 23.

The furnace is provided with inlet port means and outlet ports which are shown in FIG. 1. As shown, two inlet lines 51,51 can be provided, one leading into each of the end plates 17 and 18 and thus to the chamber inside the housing. Also, as shown, two outlet lines are provided (only one is necessary, or more than two can be provided as well), and these are indicated at 52. The outlet from the furnace is an opening through the wall of the outer housing 15 leading from the interior chamber. The inlets are positioned adjacent the inner edges of the respective discs.

Referring specifically to FIGS. 3 through 8, the details of the discs of each set of discs and the way that the pressure is generated for converting input rotary energy into heat energy is illustrated.

Figure 3:
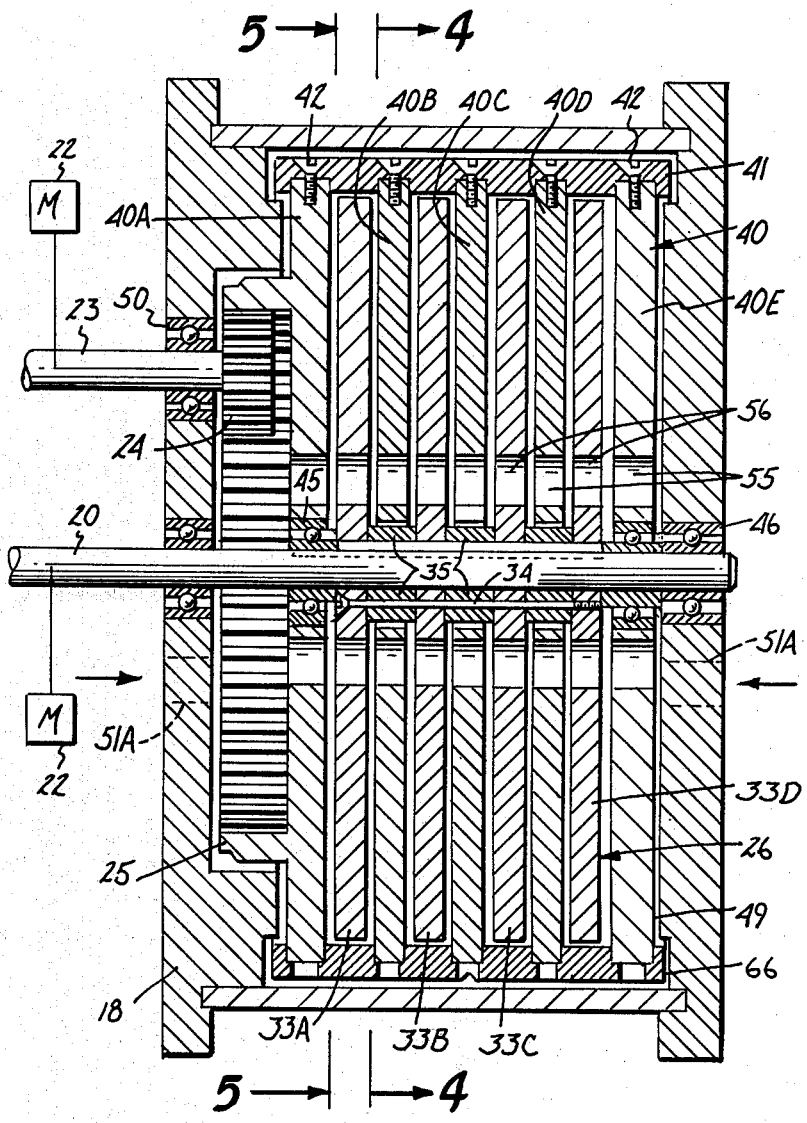
FIG. 3 is a vertical sectional view of the furnace of FIG. 2 taken along the central axis thereof.

The oil inlet lines 51 open into passageways shown at dotted lines at 51A in FIG. 3 in the end plates 17 and 18, respectively and the inlets thus open to the interior chamber 49 defined by the outer housing 15 in which the stabilizer 41 and both sets of discs are rotatably mounted as previously explained. The end discs 40A and 40E of disc set 40, which are the counterclockwise rotating discs when viewed in direction from end plate 18 toward plate 17, are the first discs on the interior chamber. As shown disc 40A has the ring gear 25 attached to it. Near the center of the discs 40A and 40E, adjacent to the axis, there are four equally spaced openings 55 passing through the discs. The openings 55 are spaced out from the central clearance opening of discs 40A–40E which provide clearance for spacers 35. Each of the discs 33A, 33B and 33C has four openings 56. The discs 40B, 40C and 40D have openings 55 as well. Thus there are passageways across the interior chamber 49 adjacent to the shaft 20 and aligned generally with the intake passageways 51, which permit hydraulic oil to flow into the interior of the housing chamber. It should be noted that the holes 55 and 56 are not drilled with the hole axes perpendicular to the discs but rather are drilled at an oblique angle to the discs as shown typically in FIG. 8. Arrow 82 shows the direction of disc 33A. The holes 56 are angled so edge 56A, on the trailing edge of the opening catches the oil and tends to move it toward the center of the housing. On next disc 40B, rotating in direction as indicated by arrow 65, the edge 55A also moves oil passing through openings 56 toward the center of the housing. The discs at the other side of the housing would be mirror images, moving oil toward disc 40C as part of the inlet means. The disc 40A would not have a taper on the holes 55, or the holes 55 may be blocked off. As will be explained, the oil also is forced radially outwardly by the rotating discs, but the inlet means and holes provide input oil.

In order to provide an adequate buildup of heat through the use of centrifugal forces as well as shear forces, each of the discs is provided with face grooves along the side surfaces of the discs leading from adjacent to the central portion or adjacent to the inlet openings 55 and 56, respectively, to the outer peripheral edges of the respective discs. The discs 40A–40E of the disc set 40 have grooves as shown in FIG. 4. The end discs 40A and 40E have grooves only on one side (the side facing the disc set 33), but discs 40B, 40C, and 40D have grooves on both sides or faces. Disc 42B is shown in FIG. 4, but the grooves on the far side of the disc are not illustrated in dotted lines for clarity. The edge view of the disc 40B is shown in FIG. 6. As can be seen, there are four face grooves 60 defined in each of its side surfaces. Disc 40B, as explained, rotates with the outer stabilizer 41 in counterclockwise direction as shown by arrow 65. The edge surfaces of the discs 40A–40E are seated on inner surfaces of the outer stabilizer 41. It should be noted that outlet openings indicated generally at 61 are provided through the stabilizer wall aligned with the outer ends of each of the grooves 60 in the discs 40B, 40C and 40D. The outlet openings 61 are drilled to have their axes at an incline, that is not on a radial line, with respect to the axis of rotation of the stabilizer. The inner ends, that is the end of the openings 61 closest to the axis of rotation are rotationally leading, while the outer ends of the openings 61 rotationally trail relative to the rotation of the stabilizer.

Each of the grooves 60 in the counterclockwise discs as shown is a spiral groove starting adjacent the openings 55. The grooves 60 change in depth along their length having a maximum depth at the outer peripheral edge of the disc shown generally at 60A to a minimum at the inner end, shown generally at 60B in FIG. 4. The inner ends of the grooves terminate adjacent to or aligned with one of the openings 55 as shown, which comprise inlets for the hydraulic fluid. The grooves 60 in this form of the invention are shallow, open faced grooves with the rotationally leading edge 60C of the grooves being the start of a shallow shaped surface 60D leading to a junction line where surface 60D joins a wall or surface 60E that tapers sharply back to the adjacent face of the disc, to form an outwardly facing shoulder tapering in depth from a maximum at the outer periphery to a minimum adjacent the axis of rotation.

Each of the grooves 60 on the counterclockwise rotating disc set 40 forms a type of a spiral or curve which with respect to a radial line passing along the inner-most end of the groove, tapers or curves outwardly, and in direction opposite to the direction of rotation, toward the outer peripheral edge of the disc. In other words, the inner ends of the grooves are rotationally leading, and the outer ends are rotationally trailing.

At the outer peripheral edge of the disc 40B, which is shown typically for the disc set 40, there is a cross recess 62 milled into the edge. The recess forms a shoulder 63 that is facing generally in the direction of rotation at a slight angle to the axis of rotation. The direction of slope of the shoulder depends on the side of the disc in which the groove 60 is milled. The shoulders are cut so that the edge of the shoulder on the side of the associated groove 60 is trailing slightly. The shoulder 63 forms a surface that is generally perpendicular to the inwardly sloping surface 60D.

There are four grooves 60 on each side of each of the discs 40B, 40C and 40D and grooves 60 on the only inwardly facing surface of the end discs 40A and 40E. Each one of these grooves 60 can be associated with an opening 55, so that as the disc is rotated in counterclockwise direction and is indicated by the arrow 65, oil supplied from the inlet lines and openings 55 will tend to be thrown outwardly by the discs around the curved portion of the grooves 60, out along the shoulders 63 and impelled through the outer openings 61 in stabilizer 41. This will form hydraulic flow under pressure from the inner inlet opening 55 to the outer peripheral edge of the stabilizer shell, out to the small space or chamber indicated generally at 66 between the stabilizer and the outer housing 15. A clearance of about 0.005 inch is provided. This pressure build-up between the outer housing 15 and the stabilizer 41 will cause a discharge of fluid through the outlet openings in the outer housing.

It should also be noted that the stabilizer includes a plurality of cross recesses indicated generally at 70 on its outer surface that form shoulders 71 providing an impeller face that tends to build-up pressure as the oil is circulated around the outer periphery of the stabilizer and is forced out through the outlet openings in housing 15.

All of the discs 40A through 40E rotate in ths same direction of rotation simultaneously with the stabilizer 41. Again it should be noted that the disc set 40 rotates counterclockwise when viewed in direction toward the right in FIG. 3, and the other disc set, namely discs 33A–33D, are rotating in opposite direction so that the grooves 60, and the oil carried thereby move past the adjacent discs under relative rotary motion. The side surfaces of the discs may be spaced in the range of 1/16 inch.

Figure 5:
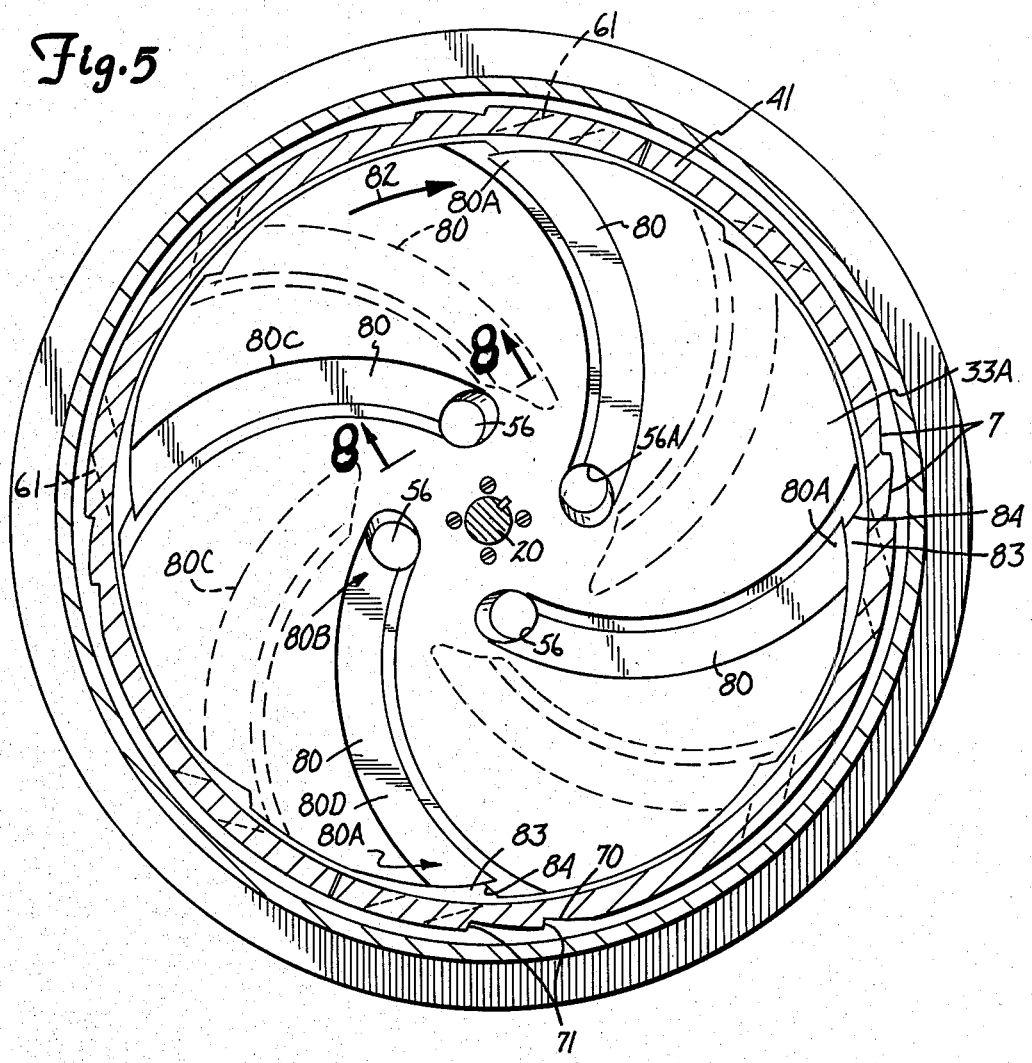
FIG. 5 is a sectional view taken as on line 5—5 in FIG. 3.

FIG. 5 illustrates a typical disc of the disc set 33, specifically disc 33A. In this particular arrangement, the disc 33A is keyed to be driven by the shaft 20, and rotates on the inside of the stabilizer or shell 41. There is a slight clearance (0.005 inches) provided between the outer peripheral edge of the disc of disc set 33 and the interior surface of the stabilizer 41. On the surface of the disc 30A seen in FIG. 5, there are four grooves 80. On the far surface of this disc, or the surface opposite that seen in FIG. 5, there are also four grooves 80 defined. The grooves 80 also are open face grooves, and with reference to FIG. 5 the grooves are at a maximum depth at an outer end indicated 80A and a minimum depth at an inner end indicated at 80B where they are adjacent to openings 56. The grooves have a leading edge 80C formed by a surface 80D that tapers inwardly from the rotationally leading edge to the inner edge of the groove where surface 80D joins a shoulder surface 80E that extends outwardly at a relatively steep angle as can be seen in FIG. 7.

The grooves 80 are also spiraled or curved from their inner ends to their outer ends at the edges of the discs in the disc set 33. The inner ends of the grooves 80 are rotationally leading with respect to a radial line, while the outer ends 80A of the grooves are rotationally trailing so that the surface 80E for example forms a spiral, generally shoulder-like surface that faces in the direction of rotation indicated by the arrow 82.

It can thus be seen that with the disc set 33 rotating as shown by the arrow 82, and the disc set 40 rotating in the direction indicated by the arrow 65, the grooves on the side surfaces of adjacent discs will pass each other and the motion will provide a sweep that tends to move hydraulic oil between the discs outwardly toward the outer edge. In other words, as the edges of the discs pass each other, there will be a counterrotating movement of the adjacent surfaces of the discs tending to force material outwardly, much like a helix, as well as with centrifugal force.

Hydraulic fluid is admitted into the openings 56 in the disc set 33, adjacent the center, and fluid will be moved outwardly by the grooves 80 as the discs rotate. The interaction with the grooves 60 and the surfaces 60E provide a high shear force on the hydraulic fluid, and creates a pressure tending to force the oil outwardly toward the outer edge.

A milled recess 83 is provided in the disc 30A at the outer peripheral edge aligned with each of the grooves. The recesses 83 form a pressure head creating shoulder 84 at the outer edge of the disc. The shoulders 84 provide an impelling force tending to throw the hydraulic fluid outwardly and also slightly axially and the pressure that is created against the inner edge of the shell 41 will force the fluid out through the openings 61 as the ends of the grooves from one of the discs in the disc set 33 and the adjacent discs in the disc set 40 pass each other. The discharge openings in the stabilizer 41 are aligned on a plane with the discs in the disc set 40, that is, the discs to which the stabilizer is attached, but the recess 62 provides an opening aligned with the opening 61 so that as the discs rotate past each other oil is forced out through the opening 61 under hydraulic pressure.

Friction and shear forces on the oil create substantial heat, and the oil is heated quickly. Then, the oil is thrown outwardly through the openings 61 into the annular space 66. The stabilizer has shoulder surfaces 71 formed on its outer surface which create more shear and pressure, raising the oil temperature so that the output oil coming through the outlet of the hydraulic furnace and out through the outlet line 52 is heated to a substantial temperature. As previously explained this oil can pass through a heat exchanger for direct heating, or may be used as a source for radiant heating. The type of heat exchanger for distributing the heat generated may be any form desired.

Generally speaking the disc sets 33 and 40 will be rotated relative to each other in opposite direction in the range of 1,750 to 2,000 rpm each, causing about 4,000 rpm relative rotation between the disc sets. One of the disc sets may be maintained stationary if desired, while the other disc set is rotated, and this will not reduce substantially the efficiency of the assembly, but will reduce the heat output, of course, because less work will be put into the oil in the furnace.

A second form of the present invention is illustrated in FIGS. 8 through 13. In this instance, the same general types of drives may be utilized, but a simplified and superior effiency interior set of discs is utilized in the modified form of the invention. The outer housing can be formed in any desired manner. The drive shown in FIGS. 1-3 is utilized with the second form with a driven center shaft, as previously explained.

In this form of the invention, an outer housing illustrated generally at 100 includes a pair of end plates 101 and 102 mounted on an outer housing 103. The outer housing 103 is an annular housing defining a generally cylindrical interior chamber 99 in which the hydraulic heat generating rotor assembly illustrated generally at 104 is mounted. There are again two sets of rotating discs that are mounted on a common rotational axis, and which have faces that are parallel to and adjacent to each other. A first set of discs 105, comprising discs 105A, 105B and 105C is supported in a desired manner, for example in the manner shown in FIG. 3. The disc set 105 is mounted onto and is surrounded by an outer stabilizer 106 which forms an annular ring as in the previous form of the invention. The stabilizer 106 is attached to the discs of disc set 105 through the use of suitable set screws 107 also as shown in the first form of the invention.

The disc set 105 is mounted to rotate around a center shaft 109 (FIG. 10) which in turn mounts a second disc set 112 comprising discs 112A and 112B. The discs 112A and 112B rotate with the shaft 109. The discs 112A and 112B are positioned between (interdigitated) adjacent discs of the disc set 105 and are closely spaced thereto. The side surfaces of the respective discs are parallel to the adjacent discs in the other set. The discs 112A and 112B rotate within the stabilizer 106 and the outer edges of the discs are relatively closely spaced from the other disc having about 0.005 inches clearance.

Figure 8:
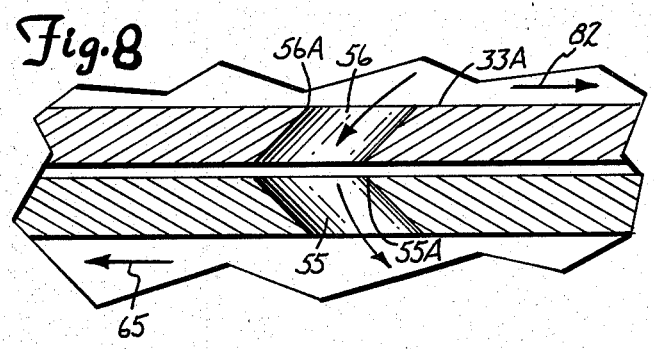
FIG. 8 is a fragmentary sectional view taken as on line 8—8 in FIG. 5.
Figure 10:
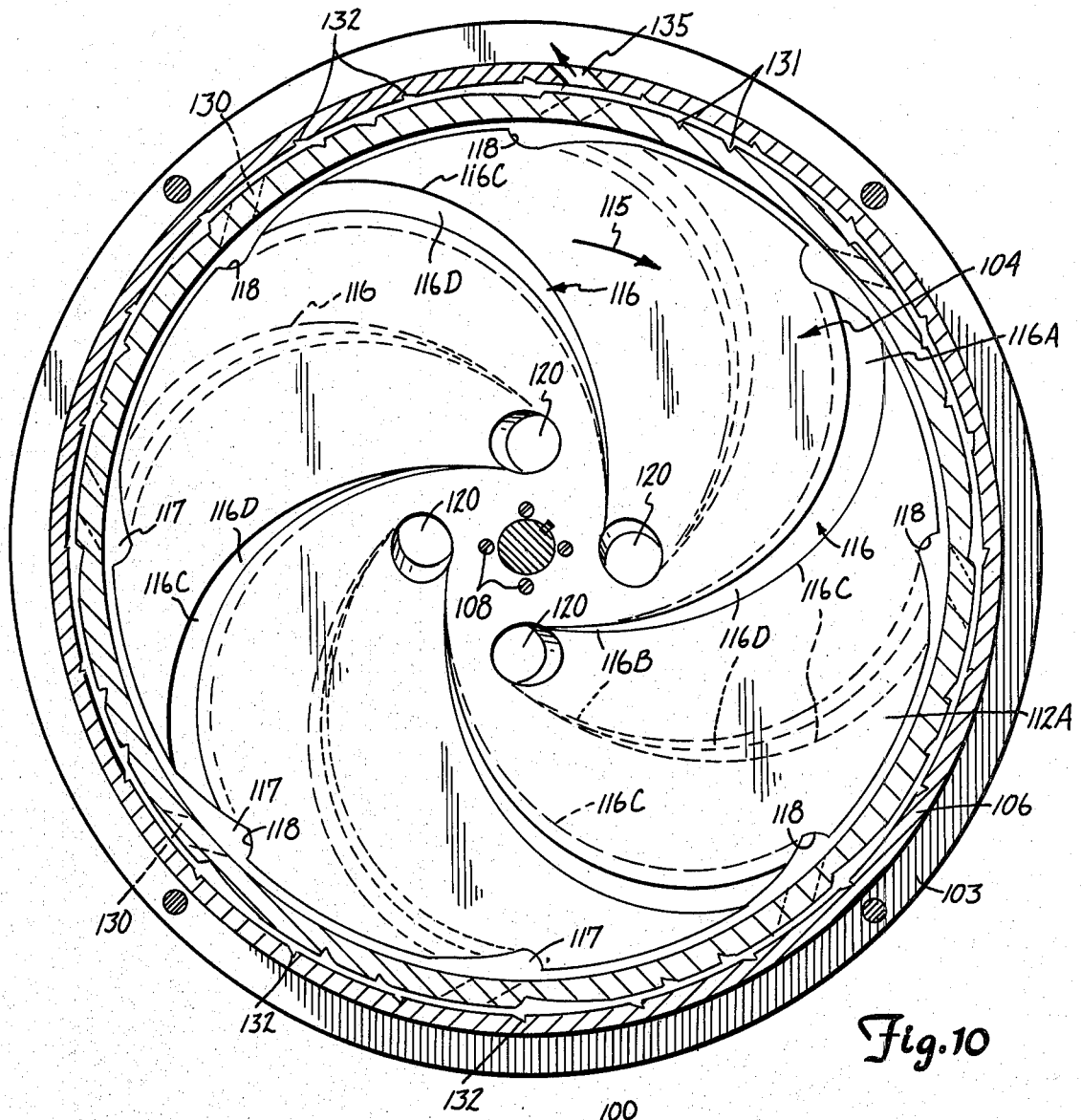
FIG. 10 is a side view of a clockwise rotating disc assembly made according to the second form of the invention.
Figure 9:
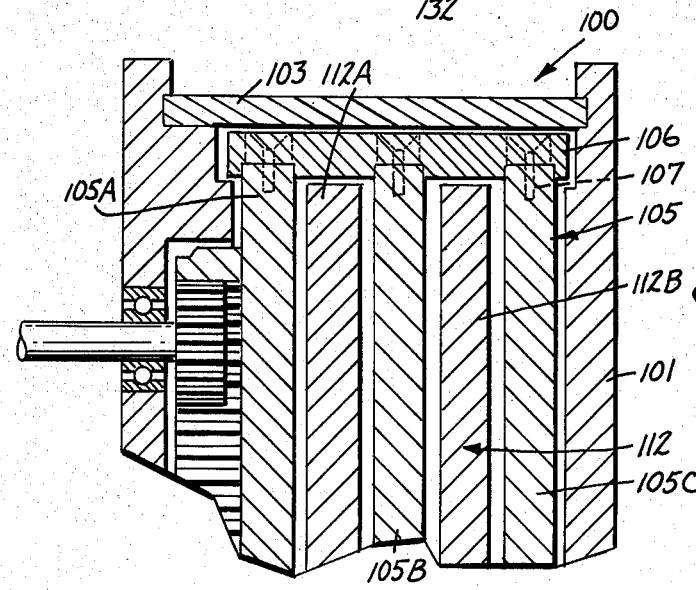
FIG. 9 is a fragmentary sectional view of the disc assembly of a second form of the invention.

FIG. 10 illustrates a side view of the disc 112A. This is the clockwise rotating disc as indicated by arrow 115. A plurality of grooves 116 are defined in the side surface, and also are tapered in depth from an outer end 116A at the outer edge of the disc, where the groove has a maximum depth (in this form approximately 5/16 of an inch) to a narrow depth of about 1/16 inch at inner end 116B. The inner end 116B terminates adjacent to an inlet oil opening 120, as shown. The openings 120 are tapered as explained in connection with disc 40 in the first form of the invention (as shown in FIG. 8).

Figure 14:
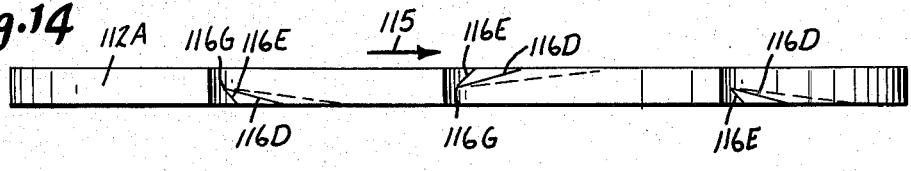
FIG. 14 is an edge view of the disc shown in FIG. 10.

In this form of the invention the grooves 116 are made so that the trailing edge of the grooves forms an undercut recess as indicated in FIG. 14. This provides an overhanging lip at the trailing edge of the groove forming a channel from the inner part of the discs to the outer edge of the disc.

The rotationally leading edge 116C is formed by an inwardly tapering surface 116D extending to the rearmost edge of the groove. An undercut surface indicated at 116E tapers out from the rear edge of groove 116 to form the overhanging lip over a part of the surface 116D. A channel is thus formed between the overhanging surface 116E and the surface 116D. The channel is open in the direction of rotation of the disc.

In this form of the grooves the channels tend to trap hydraulic oil and inhibit the oil from flowing along the face of the disc as the disc is rotated in the direction that is indicated by the arrow 115. The oil in the channel of the groove is forced in radial direction along the channel portion of groove 116 to the outer edge of the disc, where a milled out recess 117 is formed to form a head or shoulder 118 open to the outer peripheral edge of the disc. As the disc 112A rotates, this shoulder 118 forms an impeller surface to force the hydraulic oil passing outwardly along the groove 116 outwardly with greater force against the stabilizer 106. Thus, with inlet oil supplied adjacent the center of the discs 112A and 112B, the oil is forced outwardly as the discs spin.

Figure 11:
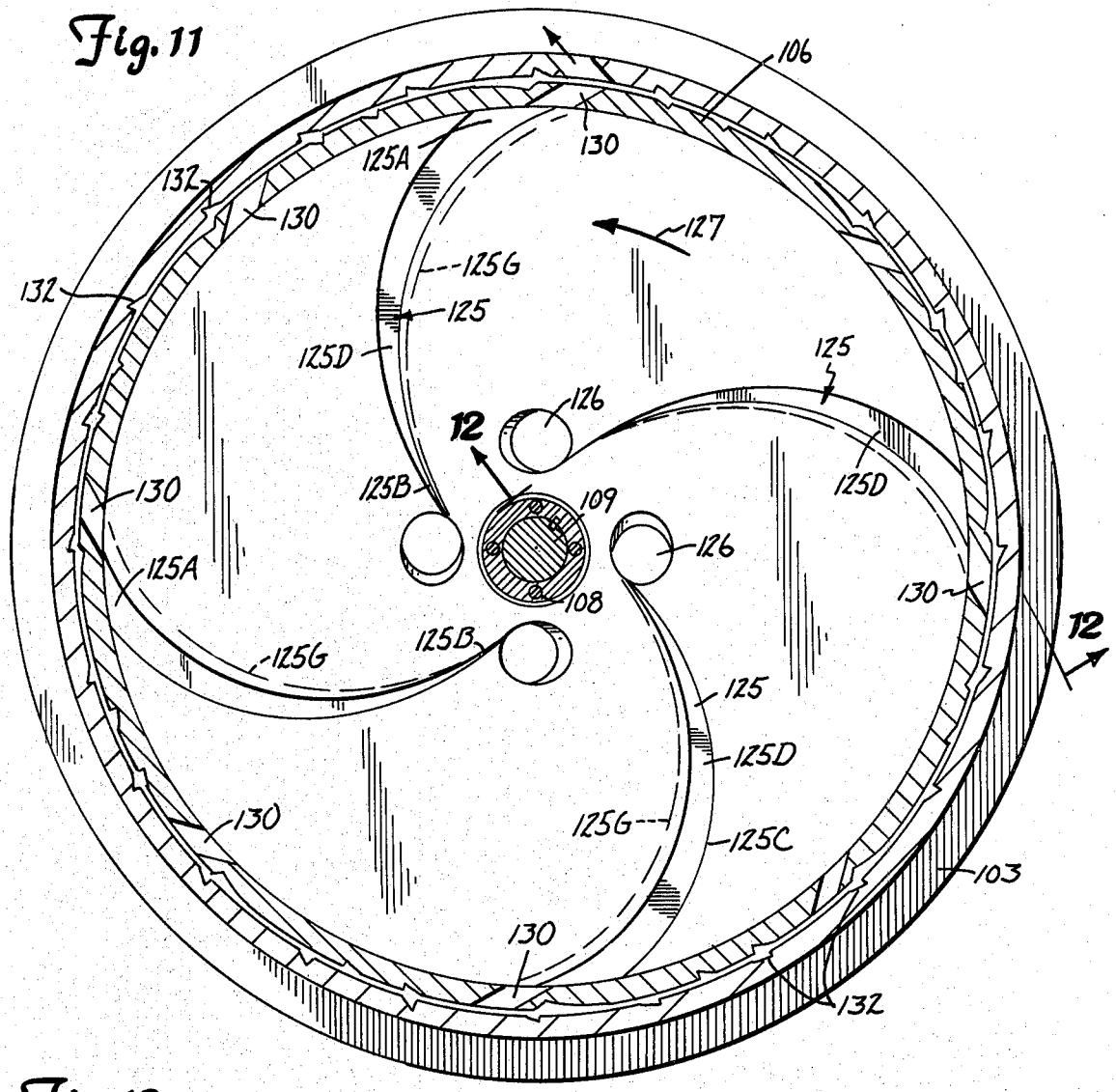
FIG. 11 is a side view of a counterclockwise rotating disc made according to a second form of the invention.
Figure 12:
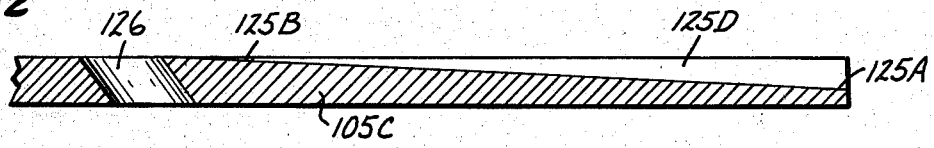
FIG. 12 is a fragmentary sectional view taken as on line 12—12 in FIG. 10.
Figure 13:
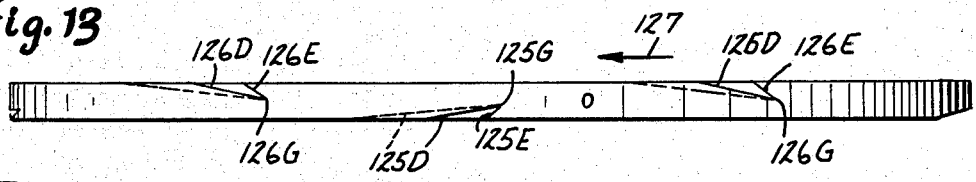
FIG. 13 is an edge view of the disc shown in FIG. 11.

The disc 105C is shown in FIG. 11, and the face thereof adjacent the disc 112B has a plurality of grooves 125 defined therein. These grooves 125 also have maximum depth at the outer or discharge end 125A and a minimum depth adjacent the inner end 125B. The inner ends 125B are adjacent the oil inlet openings or apertures 126 that provide for flow of oil to the center portions of the discs from inlets in the housing as previously explained in connection with the first form of the invention.

The disc 105C is rotated in direction as indicated by arrow 127 (counterclockwise), and as can be seen the leading edge 125C of each of the grooves 125 is formed where an inclined surface 125D commences to taper inwardly from the face of the disc. A sectional view along the length of the spiral grooves shown in FIG. 11 shows the groove as generated, with the surface 125D forming the bottom inlet surface. The depth change of the groove from its inner end to the outer end is illustrated. A surface 125E forms the rotationally trailing inner edges 125G of surface 125D and overlies the inner end of the grooves 125. A channel that faces in the direction of rotation is thus formed. The channel tends to trap hydraulic oil as the disc rotates and the oil is forced outwardly toward the outer end of the channel as the disc rotates.

In both the disc sets 112 and 105 the face grooves are spiraled, and with respect to a radial line from adjacent the inner end of the grooves, the outer ends of the grooves rotationally trail the inner ends.

The outer ends 125A of the grooves 125 on each of the discs in the disc set 105 align with an outlet opening 130 defined in the stabilizer 106. These outlet openings discharge the oil being forced radially out toward the stabilizer by the interaction between the counterrotating discs and the grooves of the discs. The grooves tend to corkscrew out fluid from the inlet openings 120 and 126 near the center of the discs out to the outer edges of the discs through the stabilizer.

The stabilizer has notches or shoulders 131 formed in the outer periphery thereof to tend to force the oil out around the outer housing 103, and increase the oil pressure, and shear the oil to increase the energy being stored in the oil as heat. Likewise, suitable shoulders can be formed on the interior surface of the outer housing 103 as shown at 132 to further increase the resistance which builds up pressure and increases the oil temperature. The shoulders 132 are spaced about one inch apart all the way around the interior of the housing.

The chamber 99 defined by the outer housing 103 thus is under greatest pressure adjacent to the wall of the housing and the hydraulic oil will be forced out through an outlet opening 135 and will be utilized in a desired manner as previously explained.

In this form of the invention, the disc inlet openings 120 and 126 also can be formed at oblique angles to the disc surface to tend to move the oil from the outer end discs toward the central discs, insuring a good flow of input oil and adequate pressure for generating enough heat to heat the oil fully. The hot oil will flow out the outlet opening (or openings) under pressure.

In a closed system (where fluid is recirculated from the outlet to the inlet), a type of fluid pressure accumulator indicated at 150 can be connected to a desired port on the outer housing 15 (or 103) to pressurize the interior of the outer housing (and the conduits in the closed system) under a preset amount of pressure. The accumulator 150 has a gas (air cushion and can be pressurized to a desired level. This serves two functions. The prepressure on the system increases the amount of energy that is put into the oil as it is forced or circulated through the furnace and thereby the temperature of the oil is increased. Also, as the temperature increases the accumulator 150 provides a place for oil to expand without substantially raising the pressure and causing any other problems. By adding air pressure or prepressure to the interior of the furnace, much higher hydraulic oil temperatures can be achieved.

The counterrotating disc hydraulic furnace can be driven from opposite ends, that is one shaft driven from one side of the furnace can be used to drive one set of discs, and the second shaft can be driven from the other side of the furnace to be used for driving the other set of discs. The counterrotating discs have spiraled grooves in their adjacent faces that are oriented so that the hydraulic oil at the interior of the discs will be forced outwardly by the discs moving past each other and the oil will be sheared, pressurized, and will be heated substantially. A compact and efficient furnace is thus formed.

What is claimed is:

1. A hydraulic furnace comprising:

an outer housing having an inner chamber with a central axis about which the chamber inner surface is generated, and end walls generally normal to the central axis;

a rotary hydraulic fluid heat developing assembly rotatably mounted within the outer housing, said heat developing assembly comprising;

first disc means extending in direction outwardly from the central axis;

second disc means adjacent to the first disc means and interdigitated with the first disc means;

an inner stabilizer shell within the housing surrounding both said first and second disc means, and being fixed to one of the disc means;

means to rotatably mount the first and second disc means relative to each other;

inlet port means provided through said housing to provide hydraulic fluid to the interior of the stabilizer shell and to the disc means adjacent the axis of rotation of said disc means;

each of said disc means including at least one disc having at least one groove defined in the face of the disc adjacent to another disc of the other disc means, said grooves extending from adjacent the port means to the outer edges of the discs and being oriented to force oil from the port means to the outer edges of the disc means when at least one of the first and second disc means is rotated; and outlet means defined in the stabilizer shell and the outer housing to permit fluid to flow out of the outlet means.

2. The apparatus of claim 1 wherein said outlet means comprises at least one opening aligned with the outer ends of the grooves in the discs of at least one disc means to permit hydraulic fluid to move outwardly from the stabilizer, and at least one outlet opening defined in the outer wall of said housing.

3. The apparatus as specified in claim 1 wherein said inlet port means comprise holes through the discs of both disc means.

4. The apparatus of claim 3 wherein the holes have axes at oblique angles with respect to the axis of rotation of the discs and oriented with respect to the direction of rotation of the discs to tend to move the fluid toward the center of the housing along the axis of rotation.

5. The apparatus of claim 1 wherein said first disc means comprises a plurality of generally flat discs comprising a first disc set and wherein said second disc means comprises a plurality of generally flat discs comprising a second disc set, and means to rotate the disc sets under power in opposite directions.

6. The apparatus of claim 1 or 5 wherein the stabilizer shell has a plurality of shoulder surfaces formed therein facing in the direction of rotation.

7. The apparatus of claim 6 wherein the inner surface of the housing has a plurality of shoulder surfaces defined therein facing in the direction opposite from the shoulder surfaces on the stabilizer shell.

8. The apparatus of claim 5 wherein the discs of each set have face surfaces extending outward from the axis of rotation and closely adjacent the face surface of adjacent discs of the other set, each face surface adjacent a face surface of a disc of the other set having a plurality of grooves defined therein and each groove comprising a leading edge in respect to the direction of rotation of the disc, and also tapering relative to a radial plane of the disc so that the end of each groove adjacent the axis of rotation rotationally leads portions of the groove spaced a greater distance from the axis of rotation.

9. The apparatus of claim 8 wherein at least some of the grooves extend to the outer edge of the respective discs and the grooves taper in depth to a maximum at the outer edge of the respective discs.

10. The apparatus of claim 8 wherein the first and second sets of discs are rotated in opposite directions.

11. The apparatus of claim 9 wherein the grooves form channel edge portions adjacent the rotationally trailing edge of the grooves which face in the direction of rotation.

12. The apparatus of claim 11 wherein the leading edges of the grooves are formed in a curve from their rotationally leading inner ends to their rotationally trailing outer ends.

13. The apparatus of claim 8 wherein the stabilizer shell is fixed to the second disc set, and a plurality of shoulder surfaces formed in the outer peripheral edge of each disc in the first set, said shoulder surfaces facing in the direction of rotation.

14. The apparatus of claim 13 wherein the shoulder surfaces are formed adjacent the rotationally trailing edge of the grooves and extend across the axial width of the respective discs.

15. A hydraulic furnace comprising:

an outer housing having a cylindrical inner chamber with a central axis about which a chamber inner surface is generated, and end walls generally normal to the central axis;

a heat developing rotor rotatably mounted within the outer housing, said heat developing rotor comprising;

a first plurality of discs having planes positioned generally normal to the central axis and being coupled together to form a first disc set;

a second plurality of discs parallel to the first discs and interdigitated with the first discs and forming a second disc set;

a stabilizer shell surrounding both said first and second disc sets, and being fixed to said second disc set;

means to rotatably mount the first and second discs relative to each other and to the housing;

inlet means provided through said housing to provide hydraulic fluid to the interior of the stabilizer and to the sets of discs adjacent the axis of rotation of said discs;

each of said discs having at least one groove defined in the face of the disc adjacent to another disc of the other set, said grooves extending from adjacent the port means to adjacent the outer edges of the discs, and being oriented to force hydraulic fluid from the inlet means to the outer edges of the discs when at least one of the first and second discs are rotated;

outlet means to permit hydraulic fluid to move outwardly from the housing; and means to permit powering at least one set of discs for rotation relative to the other.

16. The apparatus of claim 15 wherein the discs of one set are spaced sufficiently close to the discs of the other set to create shear in the hydraulic fluid as the discs relatively rotate.

* * * * *